US005269610A

United States Patent [19]

Tanida

[11] Patent Number: 5,269,610

[45] Date of Patent: Dec. 14, 1993

[54] ARMATURE DESIGN IN A WIRE MATRIX PRINTING HEAD

[75] Inventor: Toshifumi Tanida, Ome, Japan

[73] Assignee: Fujitsu Limited, Kawasaki, Japan

[21] Appl. No.: 985,443

[22] Filed: Dec. 3, 1992

Related U.S. Application Data

[63] Continuation of Ser. No. 616,076, Nov. 20, 1990, abandoned.

[30] Foreign Application Priority Data

Nov. 20, 1990 [JP] Japan ..... 1-301011

[51] Int. Cl.[5] ..... B41J 2/275

[52] U.S. Cl. ..... 400/124; 101/93.05

[58] Field of Search ..... 400/124; 101/93.05

[56] References Cited

U.S. PATENT DOCUMENTS 4,629,343 12/1986 Bernardis et al. ..... 400/124
4,737,042 4/1988 Hayashi et al. ..... 400/124
4,909,646 3/1990 Itazu ..... 400/124
5,002,412 3/1991 Ohwada ..... 400/124
5,033,885 7/1991 Gugel et al. ..... 400/124
5,074,687 12/1991 Gugel et al. ..... 400/124

FOREIGN PATENT DOCUMENTS 64766 3/1988 Japan ..... 400/124

*Primary Examiner*—David A. Wiecking
*Attorney, Agent, or Firm*—Staas & Halsey

[57] ABSTRACT

An impact wire-dot printing head comprising a frame (4, 15, 32); impact dot printing mechanisms, each comprising an armature (1) having an outer end pivotably supported by the frame means, an electric magnet for attracting the armature (1) an impact dot-wire (3) being driven in an axial direction thereof by the armature (1). The armatures (1) are radially arranged on an arrangement face perpendicular to the direction in which the dot-wires are driven, and the outer end of each armature (1) is provided with a projection (5) protruded perpendicularly to the arrangement face and in a direction opposite to the direction in which the dot-wire (3) is driven. The frame is provided with slots (6) for loosely accommodating the projections (5) of the respective armature (1), so that a movement of the armature (1) in the arrangement face is restricted.

6 Claims, 7 Drawing Sheets

ARMATURE DESIGN IN A WIRE MATRIX PRINTING HEAD

This application is a continuation of application Ser. No. 07/616,076, filed Nov. 20, 1990, now abandoned.

BACKGROUND OF THE INVENTION

1. Field of the Invention

This invention relates to an impact wire-dot printer, and more particularly, to a printing head of such a printer including actuating devices for driving dot-impact wires or rods comprising, for example, a suction type actuator.

2. Description of the Related Art

Two types of impact wire-dot printing heads are known in the prior art, i.e., an attraction type and a release type. An attraction type impact wire-dot printing head generally comprises a plurality of (e.g., 24) impact dot printing mechanisms regularly arranged to form a printing pattern; each impact dot-printing mechanism comprising an armature made of a magnetic material, and an electromagnet for attracting the armature to drive an impact dot-wire, hereinafter referred to simply as "wire", in the axial direction.

The impact wire-dot printing head known in the prior art generally comprises a plurality of (e.g., 24) impact dot printing mechanisms arranged radially and equi-angularly, and each of the impact dot-printing mechanisms comprises an armature made of a magnetic material, an electromagnet, a dot-wire, and so on. The armature is usually T-shaped and has an outer end projecting toward the respective sides along an "arrangement face". An armature support ring is provided with a pair of recesses into which the respective outer ends of the armature are loosely fit, whereby when the electromagnet is turned on, the armature is attracted thereto and is turned about a fulcrum point to push the wire outward. On the other hand, when the electromagnet is turned off, the armature is returned by a spring.

In the known printing head, however, to eliminate the T-shaped configuration of the armature, and thereby preserve a necessary gap defined between the projections of the outer ends of the adjacent two armatures, the diameter of the printing head must be increased, and thus it is difficult to reduce the size of the printing head and the printer.

SUMMARY OF THE INVENTION

Accordingly, an object of the present invention is to provide an impact wire-dot printing head capable of overcoming the disadvantages as mentioned above with respect to the prior art and capable of minimizing a diameter thereof to obtain a small-sized and light-weight printing head.

According to the present invention, there is provided an impact wire-dot printing head comprising: a frame means; a plurality of impact dot printing mechanisms, each mechanism comprising an armature made of magnetic material and having an outer end pivotably supported by said frame means, an electromagnet for attracting said armature, an impact dot-wire driven in a axial driving direction thereof by said armature; said armatures being radially arranged on an arrangement face substantially perpendicular to said direction in which said impact dot-wires are driven; characterized in that said outer end of each of said armatures has a projection protruded substantially perpendicularly to said arrangement face but opposite to said direction in which said impact dot-wire is driven; and said frame means having slots for loosely accommodating said projections of said respective armatures, so that a movement of said armature in said arrangement face is restricted.

With the impact wire-dot printing head of this invention, it is not necessary that the armature has side projected portions as in the prior art, and thus the width of the armature of this invention can be made less than that of the prior art. Also, it is possible to shorten a length of the radially arranged armatures while preserving a necessary gap between adjacent armatures, and thus a small-sized and light-weight printing head having a relatively small diameter can be obtained.

DESCRIPTION OF THE PREFERRED EMBODIMENTS

Figure 4:
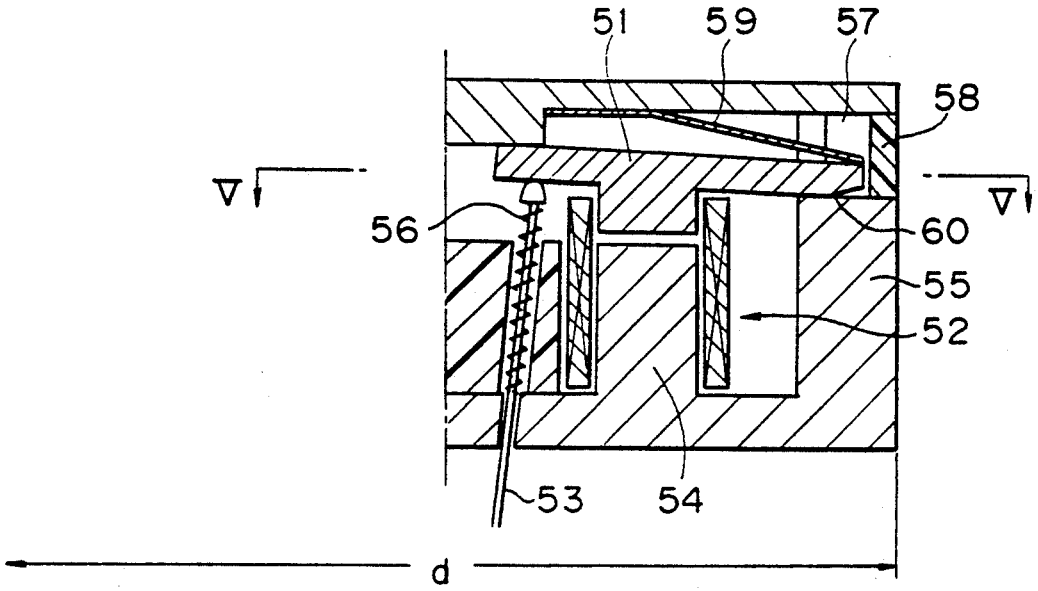
Fig. 4 (PRIOR ART)
FIG. 4 is a cross-sectional view of a printing head known in the prior art.
Figure 5:
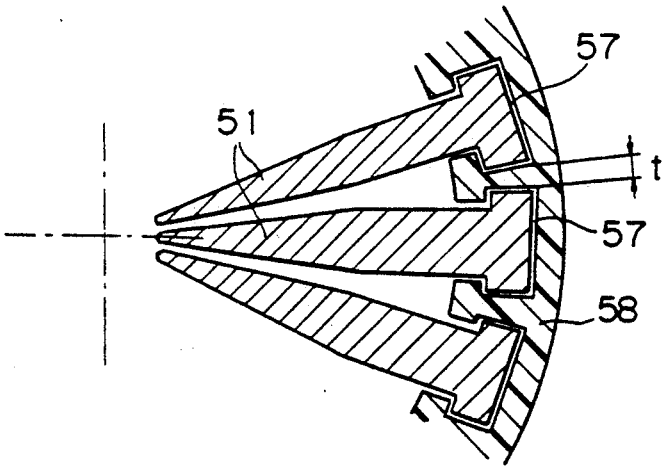
Fig. 5 (PRIOR ART)
FIG. 5 is a partial cross-sectional view taken along a line V—V in FIG. 4.

FIGS. 4 and 5 show an impact wire-dot printing head known in the prior art. The printing head comprises a plurality of (e.g., 24) impact dot printing mechanisms radially and equi-angularly arranged; each of the impact dot-printing mechanisms comprising an armature 51 made of a magnetic material, an electromagnet 52, and a dot-wire 53. The electromagnet 52 comprises an iron core 54 and a yoke 55, made of a magnetic material, and cylindrically formed integrally with the iron core 54. A spring 56 urges the wire 53 toward the armature 51.

The armature 51 is T-shaped and has an outer end projecting toward the respective sides along an "arrangement face". An armature support ring 58 is provided with a pair of recesses 57 into which the respective outer ends of the armature 51 are loosely fit in such a manner that the armature 51 is prevented from moving in the direction of the "arrangement face".

The outer end portion of the armature 51 is urged toward the yoke 55 by a counter-spring 59, in such a manner that the armature 51 is prevented from moving in the direction perpendicular to the "arrangement face". Therefore, when the electromagnet 52 is turned on, the armature 51 is attracted toward the iron core 54 of the electromagnet 52 and is turned about a fulcrum point 60 at the outer end portion thereof to thereby push the wire 53 outward. On the other hand, when the electromagnet 52 is turned off, the armature 51 is returned by the spring 56.

As mentioned above, in the known impact wire-dot printing head, to prevent a movement of the armature 51 in the direction of the "arrangement face", the outer end of the armature 51 is projected toward the respective sides to form a T-shaped configuration. Therefore, to preserve a necessary gap t (FIG. 5) defined between the projections of the outer ends of the adjacent two armatures 51, a diameter d (FIG. 4) of the printing head must be increased, and thus it is difficult to reduce the size of the printing head and the printer.

Figure 1A:
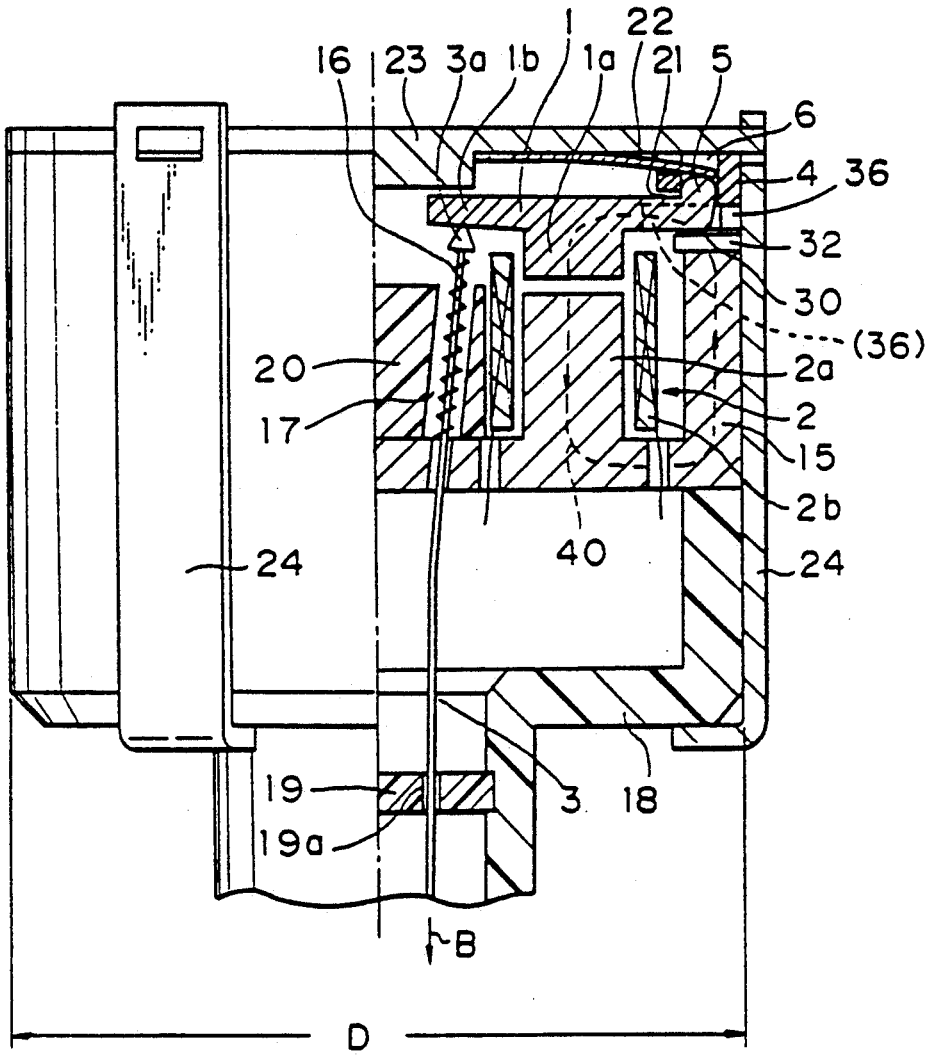
FIG. 1A illustrates a printing head according to the present invention, shown partially as a front view and partially as a cross-sectional view.

Referring now to FIGS. 1A, 1B, 2A, 2B, 2C and 2D a printing head of an impact dot printer according to the present invention comprises a plurality of impact dot-printing mechanisms, each mechanism comprising an armature 1 made of a magnetic material, such as iron, and an electromagnet 2 for attracting the armature to thereby drive a dot-wire 3, hereinafter also simply referred to as "wire 3". FIG. 1A is a cross-section view of one such impact dot-printing mechanism.

Figure 2A:
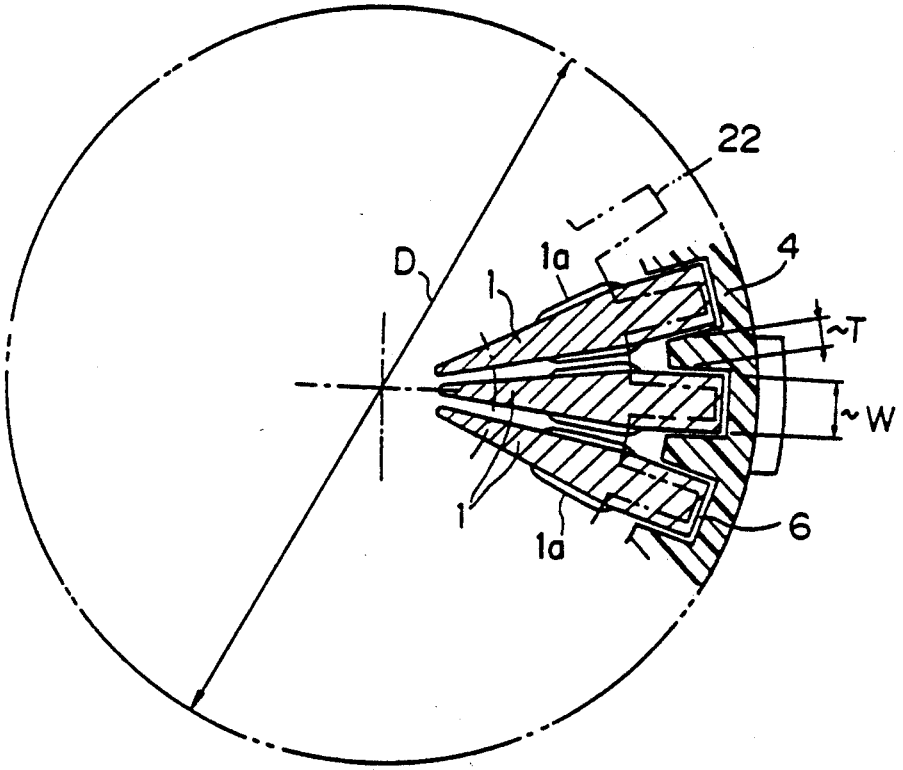
FIG. 2A is a partial cross-sectional view taken along a line II—II in FIG. 1B.

As shown in FIG. 2A, a plurality, for example 24, of these impact dot-printing mechanisms are radially arranged at predetermined equi-angles to form a cylindrical printing head. Note, although 24 such armatures 1 are radially arranged on a "armature arrangement face", FIG. 2A shows only three of these impact dot-printing mechanisms.

In FIG. 1A, the electromagnet 2 has an iron core 2*a* formed integrally with a yoke 15 made of magnetic material. The electromagnet 2 also has a magnetic coil 2*b* arranged around the iron yoke 2*a*.

The wires 3 are movable in the axial direction thereof, between a projected position and a retracted position, and are urged toward the armature 1, i.e., the retracted position, by a compression coil spring 16. The wire 3 is provided at a base end thereof with an enlarged spring retaining portion 3*a* for retaining the coil spring 16. A cylindrical member 20 made of, for example, a synthetic resin, is provided with a guide slot 17 for guiding the coil spring 16. A cover 18 is rigidly engaged with a guide plate 19 provided with a plurality of guide slots 19*a* for guiding the wires 3. Accordingly the plurality, for example 24, of wires 3 constitute a predetermined matrix dot-pattern.

A ring-shaped guide member 4, made of resin, serves to retain all of the armatures 1 in their predetermined positions and is arranged to hold, as a sandwich, the outer end portion of each of the 24 armatures with an iron block 32 mounted on the respective yokes 15. A resin film 34 made of, such as, polyimide is attached to the upper surface of the iron block 32 to prevent the armature 4 from being worn out by metal-to-metal contact. The armature 1 is provided, at a portion thereof opposite to the iron core 2*a*, with a projected portion 1*a* protruding toward the iron core 2*a*. The width of the armature 1 is gradually reduced toward a wire abutting portion 1*b*, as shown in FIG. 2A. Note, the armature 1 has a substantially constant width from the projected portion 1*a* to the outer end thereof, and has a certain cross-sectional area necessary for a magnetic circuit 40.

Figure 3:
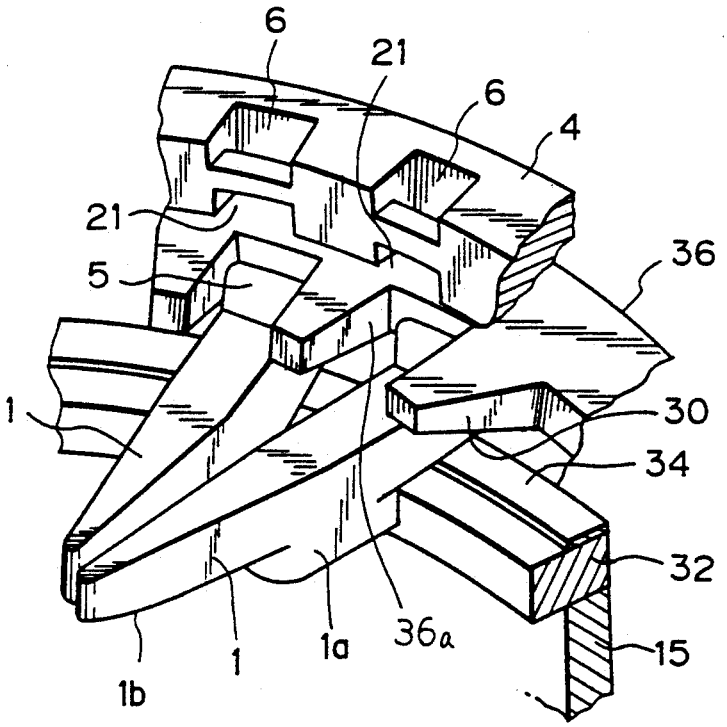
FIG. 3 is a partial exploded, perspective view of an embodiment of the present invention.

As also shown in FIG. 3, the outer portion of the armature 1 is provided with a projection 5 protruding opposite the yoke 15 in the direction perpendicular to the "armature arrangement face". The guide member 4 is provided with 24 slots 6, arranged equidistantly, into which the rear ends of the armatures 1 are loosely inserted. To prevent the rear end of the armature 1 from protruding from the end face of the guide member 4, when the projection 5 is inserted into the slot 6, the guide member 4 is provided, at positions corresponding to the respective slots 6, with recesses 21 each having a width such that the armature 1 is a loose fit in the slot 6. Also, between the guide member 4 and the iron block 32 is provided a bypass member 36 which forms a bypass magnetic path. The bypass member 36 also has comb-like slots 36*a* to restrict the armatures 4 in the lateral direction.

Figure 2B:
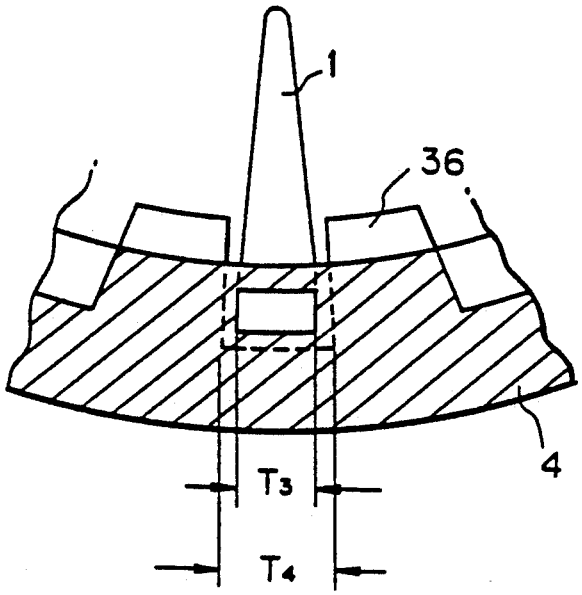
FIG. 2B is a partial enlarged view of FIG. 2A.
Figure 2C:
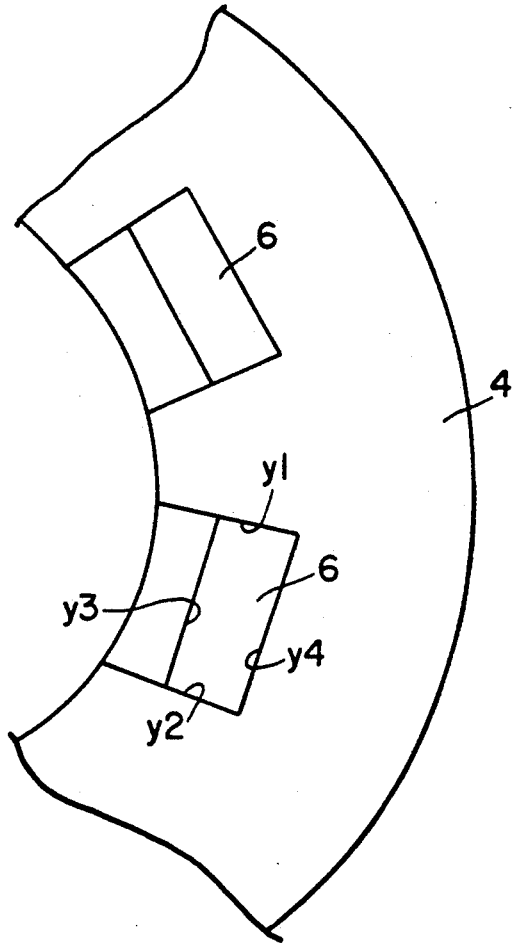
FIG. 2C is a partial top plan view showing a guide member with rectangular slots according to the present invention.
Figure 2D:
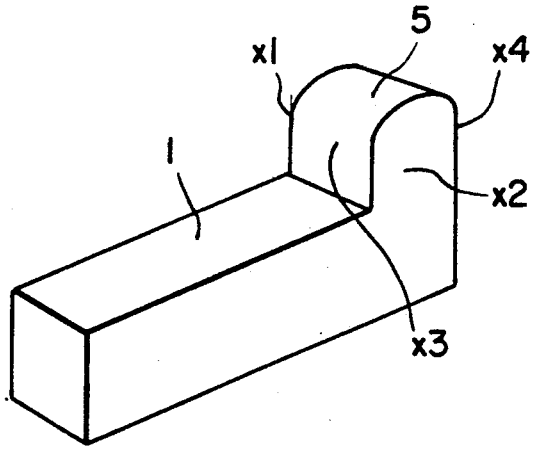
FIG. 2D is a perspective view of an outer end of an armature according to the present invention.

As shown in FIG. 2C, slot 6 is formed from side walls y1 and y2, inner end wall y3 and outer end wall y4. As shown in FIG. 2D, the projection 5 has side walls x1 and x2, inner end wall x3 and outer end wall x4. The side walls of the slot 6 confront the side walls of the projection 5 to restrict the lateral movement of the armature 1 in a direction parallel to the arrangement face. Inner and outer end walls of the slot 6 confront the inner and outer end walls of the projection 5 to restrict the longitudinal movement of the armature 1 in a direction parallel to the arrangement face.

The respective armatures 1 are thus inserted between the guide member 4 and the iron block 32, and each of the armatures 1 is retained in various directions on the "armature arrangement face". Accordingly, it is unnecessary to enlarge the width (W in FIG. 2A) of the armature to more than a minimum width thereof necessary for forming a magnetic circuit, while retaining all of the armatures 1 so that they do not move in the direction of the "armature arrangement face". Therefore, even if armatures 1 having a relatively small length are provided, a necessary width T can be defined between the adjacent slots and, therefore, a diameter D of the printing head can be reduced.

Figure 1B:
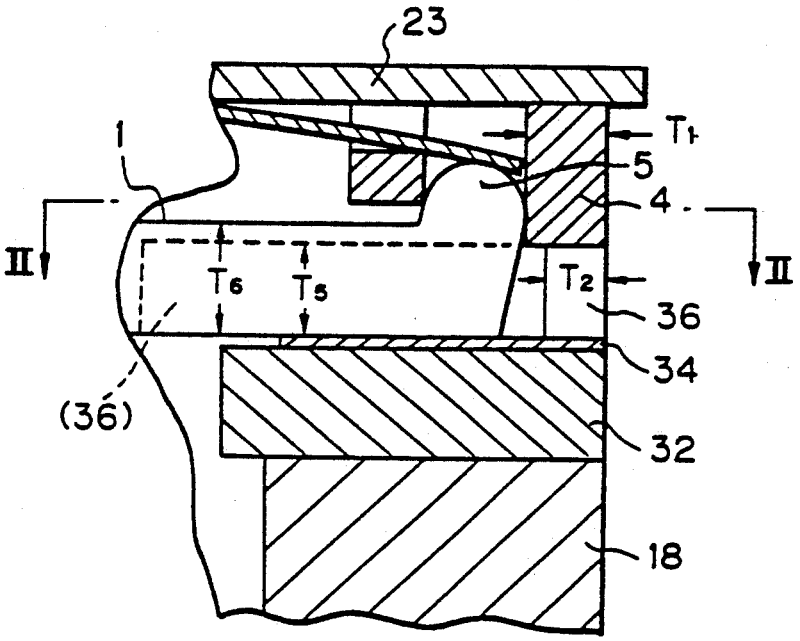
FIG. 1B is a partial enlarged view of FIG. 1A.

In FIGS. 1A and 1B, a counter-spring 22 is provided to urge the outer ends of the respective armatures 1 toward the yoke 15, and a cap 23 abuts against the end face of the guide member 4 and retains the counter-spring 22. A plurality of retaining portions 24 are provided at several positions along the outer peripheral wall of the printing head, to retain the yoke 15 and the cap 23, i.e., the retaining portions 24 prevent a detaching of the cap 23 from the printing head.

In the embodiment of an impact dot printing head as mentioned above, when power is not supplied to the magnetic coil 2*b* a magnetic force is not exerted on the armature 1, and therefore, as shown in FIGS. 1A and 1B, the wire 3 is in a retracted position and is retained thereby the coil spring 16.

When power is supplied to turn on the magnetic coil 2*b*, the armature 1 is attracted toward the electromagnet 2, and therefore, the armature 1 is turned around a fulcrum point 30 of the outer position thereof which is in contact with the resin film 34 provided on the iron block 32, and thus the wire 3 is actuated by the armature 1 and pushed in the direction indicated by an arrow B so that a tip of the wire 3 conducts an impact-dot printing operation.

In the particular embodiment, to prevent the armature 1 from directly contacting the bypass member 36, the respective dimensions are defined as follows in FIGS. 1B and 2B.

$T_1 > T_2$, $T_4 > T_3$, and $T_6 > T_5$.

It should be understood by those skilled in the art that the foregoing description relates to only a preferred embodiment of the disclosed invention, and that various changes and modifications may be made to the invention without departing from the spirit and scope thereof.

I claim:

1. An impact wire-dot printing head comprising:

a plurality of impact dot printing mechanisms, each mechanism comprising:

an impact dot-wire (3);

an armature (1) made of a magnetic material and having an outer end, the armatures (1) of the impact dot printing mechanisms being radially arranged on an arrangement face substantially perpendicular to the axial direction of the impact dot-wires (3) to drive said impact dot-wires in the axial direction thereof, the outer end of said armature being of a constant width and provided with a projection (5) having a rectangular cross-section and a width no greater than the width of said outer end protruding substantially perpendicular to said arrangement face, and in a direction opposite to said direction in which said impact dot-wire (3) is driven; and an electromagnet (2) for attracting said armature (1), said electromagnet having a magnetic coil (2*b*) arranged around a core (2*a*) which is integrally formed with a yoke (15), so that said core, said yoke and said armature define a magnetic circuit (40); and frame means (4) provided with rectangular slots (6) for loosely accommodating said projections (5) of the respective armatures (1), each said slot having an inner end wall, an outer end wall and opposite side walls so that lateral and longitudinal movement of each of said armatures (1) in a direction parallel to said arrangement face is restricted.

2. A printing head as set forth in claim 1, wherein a plurality of said armatures (1) are radially and equiangularly arranged in said arrangement face and said frame means (4, 15, 32) is substantially cylindrical.

3. A printing head as set forth in claim 2, wherein said frame means (32) has a resin film (34) attached thereto and said outer end of each of said armatures (1) is in contact with said resin film (34), at a side opposite to said projection (5), so that said outer end of said armature (1) defines a fulcrum point (30) about which said armature (1) is turned to drive said impact dot-wire (3).

4. A printing head as set forth in claim 2, wherein each of said armatures (1) has an inner end with which said impact dot-wire (3) comes into contact.

5. A printing head as set forth in claim 4, wherein said electromagnet (2) is provided with an iron core (2*a*) which is located between said inner and outer ends of each said armature (1).

6. A printing head as set forth in claim 1, wherein said impact dot-wire (3) is always urged toward said armature (1) by a compression coil spring (16).

* * * * *

UNITED STATES PATENT AND TRADEMARK OFFICE

CERTIFICATE OF CORRECTION

PATENT NO. : 5,269,610

DATED : December 14, 1993

INVENTOR(S) : Toshifumi TANIDA

It is certified that error appears in the above-indentified patent and that said Letters Patent is hereby corrected as shown below:

Title page, Item [30], change "1990" to --1989--.

Signed and Sealed this

Sixth Day of September, 1994

*Attest:*

Bruce Lehman

BRUCE LEHMAN

*Attesting Officer*

*Commissioner of Patents and Trademarks*